US007018473B2

(12) United States Patent
Shadrach, III

(10) Patent No.: US 7,018,473 B2
(45) Date of Patent: Mar. 28, 2006

(54) TOWEL DISPENSING AND TREATMENT SYSTEM

(76) Inventor: William S. Shadrach, III, 2239 Emerson Ave., Salt Lake City, UT (US) 84108

( * ) Notice: Subject to any disclaimer, the term of this patent is extended or adjusted under 35 U.S.C. 154(b) by 0 days.

(21) Appl. No.: 10/821,587

(22) Filed: Apr. 9, 2004

(65) Prior Publication Data

US 2004/0200410 A1 Oct. 14, 2004

Related U.S. Application Data

(60) Provisional application No. 60/462,181, filed on Apr. 10, 2003.

(51) Int. Cl.
*B05B 7/06* (2006.01)

(52) U.S. Cl. ..... 118/315; 118/325; 118/316

(58) Field of Classification Search ..... 118/325, 118/314, 315, 316; 206/812, 494, 233; 222/192, 222/383.1; 242/597.8, 598.5, 598.6
See application file for complete search history.

(56) References Cited

U.S. PATENT DOCUMENTS

| | | | | |
|---|---|---|---|---|
| 2,440,974 | A * | 5/1948 | Resch | 312/31 |
| 2,789,725 | A | 4/1957 | Carper | |
| 3,189,228 | A | 6/1965 | Steinbart | |
| 3,460,513 | A | 8/1969 | Hesselmann et al. | |
| 3,804,061 | A | 4/1974 | Cassar et al. | |
| 3,865,271 | A | 2/1975 | Gold | |
| 3,910,229 | A | 10/1975 | Spencer | |
| 3,947,134 | A | 3/1976 | Ogawa | |
| 4,235,333 | A | 11/1980 | Boone | |
| 4,436,224 | A | 3/1984 | McInerny | |
| 4,598,664 | A | 7/1986 | Hamlin | |
| 4,667,846 | A | 5/1987 | Marceau | |
| 4,991,538 | A | 2/1991 | Davids et al. | |
| 5,265,509 | A * | 11/1993 | Chen | 83/282 |
| 5,312,021 | A | 5/1994 | Nelson | |
| 5,672,206 | A | 9/1997 | Gorman | |
| 5,762,710 | A | 6/1998 | Ngai et al. | |
| 5,819,989 | A | 10/1998 | Saraceni | |
| 5,887,759 | A | 3/1999 | Ayigbe | |
| 6,085,899 | A * | 7/2000 | Thorsbakken | 206/205 |
| 6,138,874 | A | 10/2000 | Audrey | |
| 6,213,424 | B1 * | 4/2001 | Helfer-Grand | 242/564.1 |
| 6,343,491 | B1 | 2/2002 | Jung | |
| 6,346,153 | B1 | 2/2002 | Lake et al. | |
| 6,457,434 | B1 | 10/2002 | Lazar | |
| 6,749,148 | B1 * | 6/2004 | Helfer-Grand | 242/564.1 |
| 2002/0175175 | A1 | 11/2002 | Oshinskv et al. | |

* cited by examiner

*Primary Examiner*—Brenda A. Lamb
(74) *Attorney, Agent, or Firm*—Thorpe North & Western, LLP

(57) ABSTRACT

A dispenser to dispense towels selectively treated with a fluid, includes a compartment having an open upper end and containing at least one dispensable towel therein. A removable cover is disposable on the compartment to form an enclosure with the compartment. A towel dispensing conduit extends through the cover to a top opening of the cover, the conduit defining a path through which the dispensable towel is extracted from the compartment and dispensed from the top opening of the cover. A fluid application assembly is associated with the removable cover. The fluid application assembly includes a fluid reservoir, oriented over the compartment when the cover is disposed on the compartment, and being configured to receive and store the fluid therein; and a fluid applicator, in fluid communication with the reservoir and being selectively operable by a user to selectively apply the fluid to the dispensable towel as the towel is dispensed from the dispenser.

20 Claims, 4 Drawing Sheets

TOWEL DISPENSING AND TREATMENT SYSTEM

Priority is claimed from U.S. Provisional Patent Application No. 60/462,181, filed Apr. 10, 2003, which is hereby incorporated herein by reference.

BACKGROUND OF THE INVENTION

1. Field of the Invention

The present invention relates generally to towel dispensing systems. More particularly, the present invention relates to towel dispensing systems that selectively apply a fluid to a towel as it is dispensed from the system.

2. Related Art

Towels that have been treated with a particular substance have been produced for some time. For example, so called "baby wipes" are towels treated with a mild cleaning agent or other substance for cleaning a baby's skin. Such wipes are generally treated with the cleaning agent or other substance and packaged into a container from which the wipes can be individually dispensed. Similar products sold include towels treated with detergent, hand cleaner, furniture polish, car wax, etc. Such products have been provided in a dispensing container that can be easily carried or stored within a vehicle of a consumer.

While such pre-treated products have met with some commercial success, they have proved costly and problematic, in that a consumer can generally only use the towels for the purpose for which the towels were treated. For example, the consumer can use the baby wipes to clean a baby's skin, but the wipes are not as effective in an application where a dry towel would perform best; or in the case where a towel treated with a different substance would perform best. Thus, in order to address the need for cleaning or treating a variety of surfaces, it has generally been necessary for a consumer to purchase multiple packages of towels.

In addition to products which dispense pre-treated towels, systems have been developed that allow consumers to apply a particular substance to a towel. In these systems, "dry," or untreated, towels are dispensed and a consumer can apply the fluid to the towel if the consumer desires a treated towel.

These systems suffer from a variety problems as well. For example, many of these systems are designed to treat towels dispensed from conventional dry towel systems, such as paper towels dispensers or toilet tissue dispensers. As such, many of these systems are limited to applications in which a towel dispenser system is permanently mounted to an existing structure, such as is the case when a toilet tissue dispenser is mounted to a wall or cabinet structure. In these applications, the fluid application system is generally mounted to the same wall or cabinet structure. The resulting system is accordingly not easily portable and as a result can only be effectively used in applications near the wall or cabinet structure.

In addition, many of these systems involve highly sophisticated towel feeding mechanisms and fluid pumping mechanisms which are incorporated into the stationary structure. Such systems are not only overly complex and bulky, but often are configured to operate in only one, predetermined, orientation. As a result, even if such systems can be moved from one location to another, they must generally be placed or mounted on a stable support surface in the predetermined orientation to operate properly. In addition to not being operable in alternate orientations, the systems generally do not include fluid containment systems that contain the fluid in a variety of orientations. Thus, if the systems are moved or tipped, the fluid can spill or leak into a surrounding environment, or onto the supply of untreated towels.

SUMMARY OF THE INVENTION

It has been recognized that it would be advantageous to develop a towel dispensing system that selectively applies a fluid to the towels as the towels are dispensed. In addition, it has been recognized that it would be advantageous to develop a towel dispensing system that can be easily transported from one location to another, and that can be operated in a variety of orientations.

The invention provides a dispenser configured to dispense towels selectively treated with a fluid, including a compartment having an open upper end and being configured to contain at least one dispensable towel therein. A removable cover can be disposable over the open upper end of the compartment to form an enclosure with the compartment. A towel dispensing conduit can extend through the cover to a top opening of the cover. The conduit can define a path through which the dispensable towel is extracted from the compartment and dispensed from the top opening of the cover. A fluid application assembly can be associated with the removable cover and can include: a fluid reservoir, oriented over the compartment when the cover is disposed on the compartment, and being configured to receive and store the fluid therein; and a fluid applicator, in fluid communication with the reservoir and being selectively operable by a user to selectively apply the fluid to the dispensable towel as the towel is dispensed from the dispenser.

In accordance with a more detailed aspect of the present invention, a portable dispenser configured to dispense towels selectively treated with a fluid is provided, including a compartment, configured to contain at least one dispensable towel therein. A removable cover can be disposable on the compartment to form an enclosure with the compartment. The dispenser can include a fluid reservoir and a fluid applicator, in fluid communication with the reservoir and being selectively operable by a user of the dispenser to apply the fluid to the dispensable towel. The enclosure can have at least two configurations: an upright configuration, in which a longitudinal axis of the enclosure is substantially vertical; and a slanted configuration, in which the longitudinal axis of the enclosure is slanted with respect to vertical. The fluid applicator and reservoir can cooperatively define a sealed unit to contain the fluid within the cover when the dispenser is oriented in either or both the upright configuration and the slanted configuration.

In accordance with another aspect of the invention, a method for dispensing towels contained in a compartment and selectively treated with a fluid is provided, including the steps of: extracting a dispensable towel from the compartment, through a towel delivery conduit extending through a removable cover disposed on the compartment, and from a top opening of the cover; and selectively applying the fluid to the towel as the towel is extracted through the conduit.

Additional features and advantages of the invention will be apparent from the detailed description which follows, taken in conjunction with the accompanying drawings, which together illustrate, by way of example, features of the invention.

DETAILED DESCRIPTION

Figure 1:
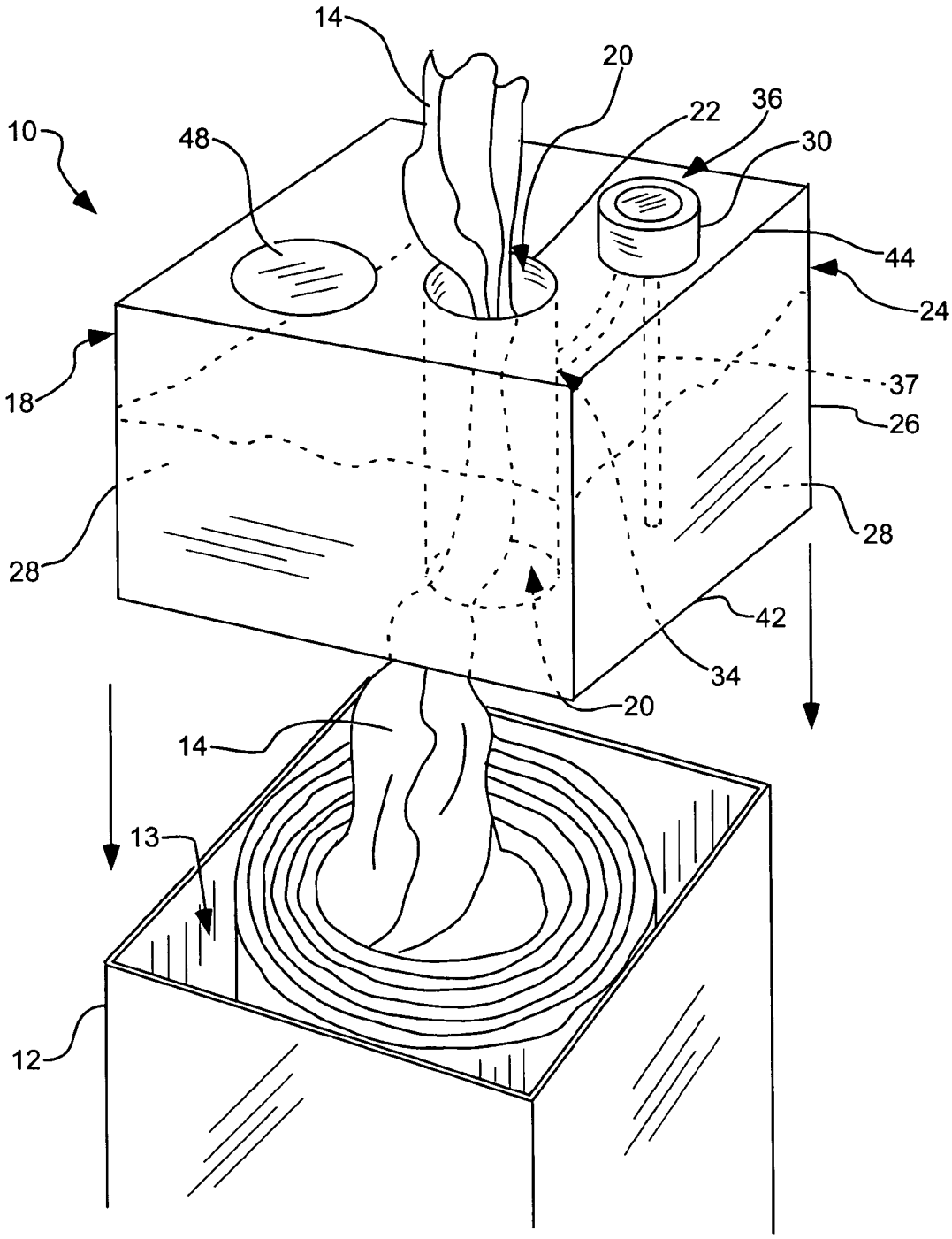
FIG. 1 is a perspective view of a towel dispenser in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

As illustrated in FIG. 1, a towel dispenser, indicated generally at 10, in accordance with the present invention is shown for dispensing towels that are selectively treated with a fluid or liquid. The dispenser 10 can include a compartment 12 that can be configured to contain at least one dispensable towel 14 therein. The compartment can include an open upper end 13, and a removable cover 18 can be disposable on the compartment and can include a towel dispensing conduit 20. The dispensing conduit can extend through the cover to a top opening 22 of the cover to thereby define a path through which the dispensable towel can be extracted from the compartment and dispensed from the top opening of the cover.

A fluid application assembly 24 can be associated within the removable cover 18 and can include a fluid reservoir 26 which can be oriented over the compartment 12 when the cover is disposed on the compartment. The fluid reservoir can be configured to receive and store a fluid 28 therein. The fluid application assembly can also include a fluid applicator 30 in fluid communication with the reservoir. The fluid applicator can be selectively operable by a user of the dispenser to selectively apply the fluid to the dispensable towel as the towel is extracted from the dispenser.

The dispenser can be advantageously utilized in a number of applications that can benefit from a selectively operable towel treatment system. In one aspect of the invention, the towels are disposed within the compartment in a "dry," or untreated, condition. When a user desires a treated towel, he or she can dispense a towel while simultaneously applying fluid to the towel. The treated towel can then be used in a variety of manners, depending upon the fluid contained in the reservoir. In the case where the fluid is a cleaning agent, the treated towel can be used to clean a surface. In the case where the fluid is a treatment fluid, such as furniture polish, the towel can be used to apply the fluid to a surface. Examples of suitable fluids for use with the present invention include, without limitation, detergent, disinfectant, hand cleaner, polish, furniture oil, leather cleaner, etc., as would occur to one skilled in the art. As used herein, the term "fluid" is to be understood to mean a generally flowable material, including liquids, pastes, creams, gels, powders, and the like, as would occur to one skilled in the art.

Regardless of the type of fluid stored in the reservoir, the user has the option of dispensing either a treated towel or an untreated towel. In this manner, the condition of the towel can be optimized for the desired application. Also, fluid is not wasted in applications where an untreated towel will perform best. As the fluid application system can be manually and selectively operable, more or less fluid can be applied to a towel, at the user's option, in order to optimize the application of the fluid for a particular job. For example, in the case where a surface to be cleaned is exceptionally soiled, more fluid can be applied to the towel than might otherwise be applied for a less soiled surface.

The type of towel suitable for use in the dispenser can also vary for particular applications. Examples of suitable towels include, but are not limited to, towels formed of paper, cloth towels, polymer towels, etc., as are known to those skilled in the art. The type of towel used can be tailored to the type of fluid used, as more caustic fluids, or fluids used in a more abrasive application, may require a more durable towel. In addition, the form in which the towels are disposed or stored in the compartment can vary. The dispensable towel 14 shown in FIG. 1 is a rolled, substantially continuous towel sheet which can be fed through the conduit 20 and torn, cut or otherwise separated to dispense a single, usable towel unit.

Figure 2:
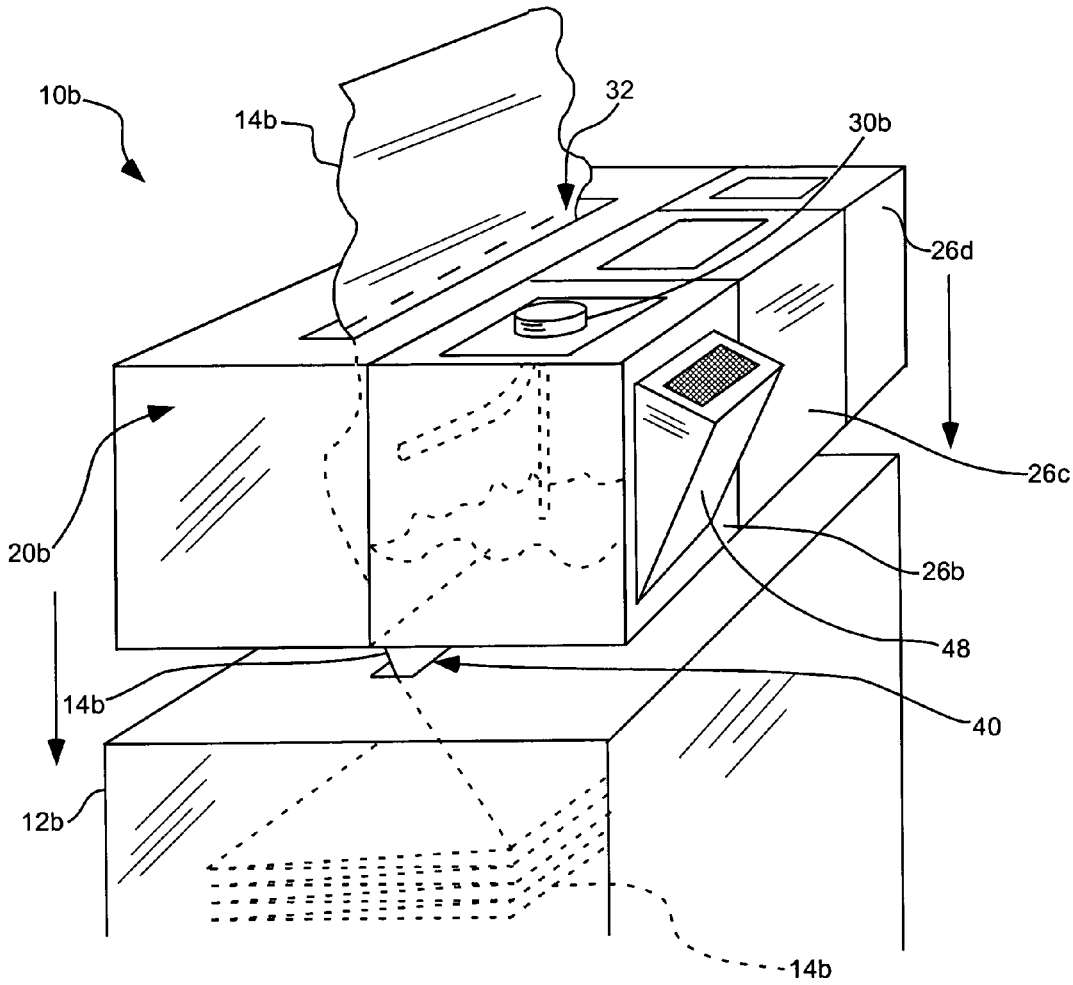
FIG. 2 is a perspective view of another towel dispenser in accordance with an embodiment of the invention.

In another aspect, shown for example in FIG. 2, the towel 14*b* can include a substantially continuous sheet including a series of perforations 32 which can aid in separating a single towel unit from the towel sheet. In another embodiment, the towel can include interfolded towels, similar to facial tissues, which are stacked and interfolded such that removal of one of the towels lifts a second towel into position for removal from the compartment.

The present invention can advantageously be replenishable with both replacement towels and replacement fluids. For example, after the fluid has been depleted from the reservoir, the reservoir can be replenished with a like fluid, or a different fluid if user so desires, by accessing openable section 48, shown in the embodiments of FIG. 1 and FIG. 2. In this manner, consumers can reduce costs associated with dispensing treated towels by purchasing replacement towels and fluid in bulk, then re-using the unit to minimize the costs associated with each treated towel used.

Figure 3A:
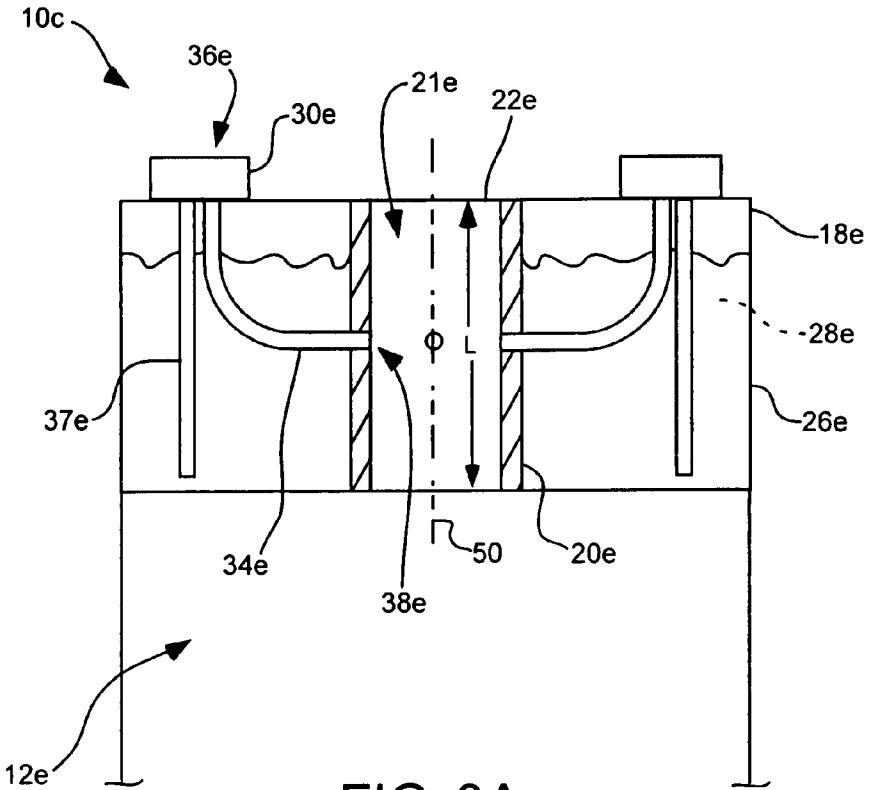
FIG. 3A is a front, partially sectioned view of a fluid reservoir and fluid applicator in accordance with an embodiment of the invention.
Figure 3B:
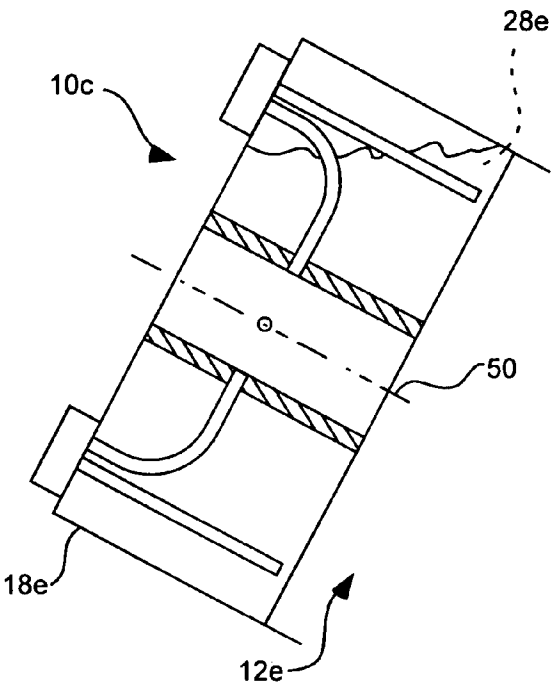
FIG. 3B is a front, partially sectioned view of the fluid reservoir and fluid applicator of FIG. 3A, shown in a slanted or tipped orientation.

As best shown in cross section in FIGS. 3A and 3B, fluid applicator 30*e* can include a delivery portion 34*e* that can be directed toward an inside 21*e* of the towel dispensing conduit 20*e*. The towel dispensing conduit can circumscribe the dispensable towel (not shown in FIGS. 3A and 3B) as the towel is extracted from the compartment. Thus, as the towel travels through the conduit, the towel is substantially surrounded by the conduit. As the fluid 28*e* is applied to the towel via delivery portion 34*e* directed toward the inside of the conduit, the walls of the conduit can serve to capture or contain any of the fluid overspray that may not be absorbed or carried by the towel. In this manner, overspray of the fluid can be contained and not be dispersed into a surrounding environment. Similarly, the conduit can contain overspray from contaminating the untreated towels contained with the compartment 12*e* below the conduit.

To aid in containing any fluid overspray within the towel delivery conduit, the conduit can include retention means (not shown) that allow the towel to pass into and out of the conduit, but resist the passage of liquid out of the conduit. The retention means can be of a variety of types, including flexible fingers or arms that converge at a point through which the towel travels. As the towel is dispensed through the conduit, the fingers can flex to allow movement of the towel but resist the flow of fluid out of the conduit. The retention means can also include an openable "iris" configuration which opens to allow the towel to travel and closes when the towel is stationary.

The towel dispensing conduit 20*e* can have a length L. To aid in containing overspray and in evenly applying the fluid to the towel, the delivery portion 34*e* of the fluid applicator 30*e* can be directed toward the inside 21*e* of the conduit at a midpoint of the length L of the conduit, as shown in FIG. 3A. By applying the fluid to the towel at the midpoint of the conduit, contamination of the untreated towel in the compartment 12*e* is minimized while also allowing the towel to absorb a majority of the fluid applied to the towel before the towel leaves the conduit. In this manner, accumulation of fluid on the top of the cover 18*e* is minimized. This feature can be advantageous when the fluid utilized may otherwise partially dry and clog the opening 22*e* in the cover.

In the embodiment shown in FIG. 3A, the fluid applicator 30*e* can include a selectively operable pump 36*e,* which can be operated, for example, by depressing a portion of the pump, as is well known in the art. The applicator can be in fluid communication with the fluid reservoir 26*e* by way of intake tube 37*e*. The delivery portion 34*e* of the fluid applicator can include a spray nozzle 38*e* directed toward the inside 21*e* of the conduit. In this manner, the fluid is sprayed onto the towel as the towel travels through the conduit. While a manual fluid applicator can be used, it is to be understood that the fluid applicator and/or pump can be mechanized and can be powered, for example, by electric current. Other pumping mechanisms, as are known in the art, can also be utilized.

In addition to utilizing the pump and nozzle spray configuration of FIG. 3A, the fluid applicator can be of a variety of configurations known to those in the art, including roller application assemblies, sponge applicators, etc. (not shown). Each of these configurations can include a fluid applicator as well as various means for moving the applicator and the towel relative to each other. For example, in the case where a roller application system is used, the system can include a mechanism for moving the roller toward and away from the towel to allow fluid to be selectively applied to the towel by a user.

Figure 4A:
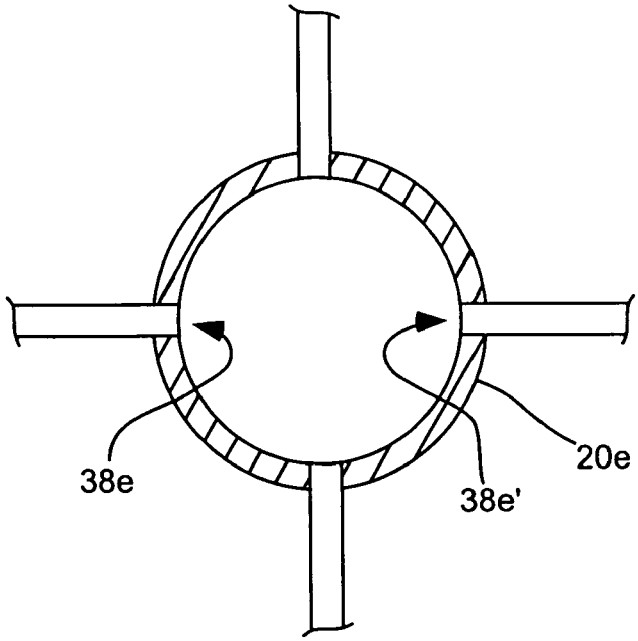
FIG. 4A is a partially sectioned top view of a towel delivery conduit and fluid applicator in accordance with an embodiment of the invention.

As shown in top view in FIG. 4A, the towel dispensing conduit 20*e* (similar to the conduit 20 of FIG. 1) can include a rounded cross section. The rounded cross section can be advantageous in that sharp comers are not present in the conduit, as the case may be if the conduit includes a rectangular shape. Sharp comers in the conduit may present areas in which fluid can accumulate due to overspray or over-application of the fluid. In one aspect of the invention, the rounded cross section includes a circular cross section. The round cross section can be advantageous in the case where multiple fluid applicators are used, as the multiple applicators can be evenly spaced about the path of travel of the towel.

Figure 4B:
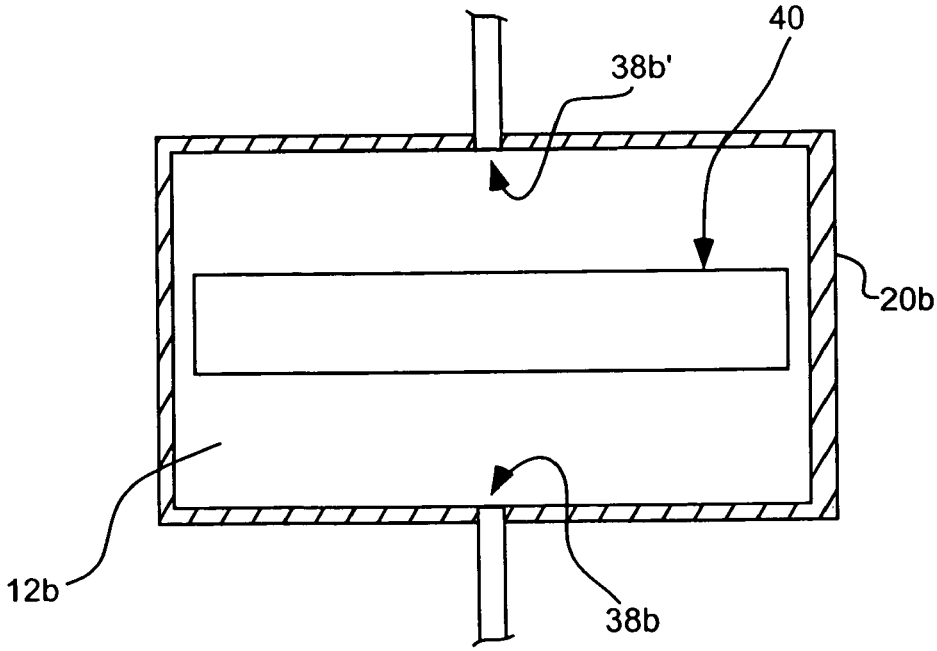
FIG. 4B is a partially sectioned top view of another towel delivery conduit and fluid applicator in accordance with an embodiment of the invention.

In one embodiment of the invention, shown in FIGS. 2 and 4B, the towel dispensing conduit 20*b* can include a rectangular cross section, which can be disposed over an opening 40 in the compartment or container 12*b*. In each of the embodiments shown in FIGS. 4A and 4B, a second fluid applicator can be provided and can have a second delivery portion 38*e*', 38*b*', respectively, directed toward the inside of the towel dispensing conduit 20*e, 20*b,* respectively. In this manner, fluid can be applied to the towel in more than one application direction, resulting in a heavier and/or more uniform coverage of the towel as the towel is extracted from the towel delivery conduit.

While the towel dispensing conduit is shown in the figures as generally defining a closed channel through which the towel travels, it is to be understood that the conduit can include open portions. The conduit can include, for example, a "C" shaped cross section or similar shape that is open on one or more sides and may not completely circumscribe the path through which the towel travels.

Returning now to FIG. 1, the towel dispensing conduit 20 can extend at least partially through the fluid reservoir 26 and can be substantially centered within a cross section of the fluid reservoir. The towel dispensing conduit can also extend through the fluid reservoir from a bottom 42 of the reservoir to a top 44 of the reservoir. In this manner, the reservoir is oriented adjacent to or around the towel dispensing conduit to limit the distance fluid must be pumped, or otherwise moved, from the reservoir to the conduit. By orienting the reservoir in near vicinity to the conduit, the complexity of the fluid pumping or moving system can be reduced, resulting in a less expensive and more reliable system. In addition, by forming the fluid reservoir uniformly about the conduit and across the width of the cover 18, the weight of the fluid is more evenly distributed across the dispenser. By evenly distributing the weight of the fluid across the dispenser, the dispenser is more stable and less likely to tip than conventional dispensers that concentrate the weight of the fluid on one side or another of the dispenser.

Returning to FIG. 2, another dispenser 10*b* in accordance with the present invention is shown. In this aspect, a plurality of fluid reservoirs 26*b, 26*c* and 26*d* can be provided. Each reservoir can be configured to receive and store a different fluid therein. Each reservoir can also be equipped with a suitable fluid application system, i.e., 30*b,* and can be refillable, for example, through openable section 48. This embodiment can be advantageous in that a plurality of fluids can be provided to consumers who can then selectively apply one or more of the fluids to the towel 14*b* as the towel is extracted from the dispenser. Also, as in other embodiments, the consumer can choose to dispense an untreated towel.

The fluids contained in the reservoirs can be of a variety of types and can be selected so as to complement one another. For example, the fluids may each relate to some type of cleaning, polishing or disinfecting application. A custodial worker can thus carry or transport one dispenser for use in a variety of cleaning operations. In another example, fluids which relate to automobile detailing can be provided in the plurality of reservoirs to consolidate the equipment required in an automobile detailing operation.

FIGS. 3A and 3B illustrate another aspect of the invention. In this embodiment, the portable dispenser 10*c* can be configured to dispense towels (not shown in FIGS. 3A and 3B) selectively treated with a fluid 28*e*. A compartment 12*e* can be configured to contain at least one dispensable towel therein. A removable cover 18*e* can be disposable on the compartment to form an enclosure with the compartment. A towel dispensing conduit 20*e* can extend through the cover to a top opening 22*e* of the cover. The conduit can thus define a path through which the dispensable towel is extracted from the compartment and dispensed from the top opening of the cover.

A fluid reservoir 26*e,* and a fluid applicator 30*e* in fluid communication with the reservoir, can be selectively operable by a user of the dispenser to apply the fluid to the dispensable towel. The enclosure can have at least two configurations: i) an upright configuration, in which a longitudinal axis 50 of the enclosure or dispenser is substantially vertical, as shown in FIG. 3A, and ii) a slanted configuration, in which the longitudinal axis of the enclosure is slanted with respect to vertical, as shown in FIG. 3B. In this embodiment, the fluid applicator and reservoir can cooperatively define a sealed unit to contain the fluid within the cover when the dispenser is oriented in either or both of the upright configuration and/or the slanted configuration.

This embodiment can advantageously provide a portable dispenser for use in a variety of locations and applications. As the enclosure formed by the compartment and the cover contains the fluid in either the upright or slanted orientation, the dispenser can be stored in an orientation most suitable for a storage location without fear that the dispenser will leak or spill fluid. The dispenser can also operate equally well in either a vertical or a tipped orientation. As one example of the advantages of this embodiment, the dispenser can be stored on its side in a glove compartment of an automobile and a user can simply open the glove compartment, dispense a treated or untreated towel, then close the glove compartment; all without having to orient the dispenser in the upward orientation prior to dispensing a towel.

In addition to the embodiments discussed above, the present invention also provides a method for utilizing the inventive structure disclosed herein. In one aspect, a method for dispensing towels contained in a compartment and selectively treated with a fluid includes the steps of: extracting a dispensable towel from the compartment, through a towel delivery conduit extending through a removable cover disposed on the compartment, and from a top opening of the cover; and selectively applying the fluid to the towel as the towel is extracted through the conduit.

The method can include the further step of containing excess fluid directed to the towel within the towel dispensing conduit. The step of applying the fluid to the towel can include the further step of applying the fluid to the towel at a midpoint of a length of the towel dispensing conduit. The step of applying the fluid to the towel can include the step of spraying the liquid on the towel. The method can include the further step of applying the fluid to the towel from at least two application directions.

It is to be understood that the above-referenced arrangements are illustrative of the application for the principles of the present invention. It will be apparent to those of ordinary skill in the art that numerous modifications can be made without departing from the principles and concepts of the invention as set forth in the claims.

What is claimed is:

1. A dispenser configured to dispense towels selectively treated with a fluid, comprising:

a compartment having an open upper end and being configured to contain at least one dispensable towel therein;

a removable cover, disposable over the open upper end of the compartment to form an enclosure with the compartment;

a towel dispensing conduit, extending through the cover to a top opening of the cover, the conduit defining a path through which the dispensable towel is extracted from the compartment and dispensed from the top opening of the cover; and a fluid application assembly, associated with the cover, the fluid application assembly comprising;

a fluid reservoir, oriented over the compartment when the cover is disposed on the compartment, and being configured to receive and store the fluid therein;

a fluid applicator, in fluid communication with the reservoir and being selectively operable by a user to selectively apply the fluid to the dispensable towel as the towel is dispensed from the dispenser.

2. The dispenser of claim 1, wherein the fluid applicator includes a delivery portion directed toward an inside of the towel dispensing conduit, and wherein the towel dispensing conduit circumscribes the dispensable towel as the towel is extracted from the compartment.

3. The dispenser of claim 2, wherein the towel dispensing conduit has a length and includes a substantially rounded cross section, and wherein the delivery portion of the fluid applicator is directed toward the inside of the conduit at substantially a midpoint along the length of the conduit.

4. The dispenser of claim 3, wherein the fluid applicator includes a selectively operable pump and wherein the delivery portion of the fluid applicator includes a spray nozzle directed toward the inside of the conduit.

5. The dispenser of claim 3, wherein the towel dispensing conduit includes a circular cross section.

6. The dispenser of claim 2, further comprising a second fluid applicator having a second delivery portion directed toward the inside of the towel dispensing conduit.

7. The dispenser of claim 1, wherein the towel dispensing conduit extends at feast partially through the fluid reservoir and is substantially centered within a cross section of the fluid reservoir.

8. The dispenser of claim 1, wherein the towel dispensing conduit extends through the fluid reservoir from substantially a bottom of the reservoir to substantially a top of the reservoir.

9. The dispenser of claim 1, further comprising at least one dispensable towel selected from the group consisting of: interfolded towels; a continuous, perforated towel sheet; a continuous, perforated towel sheet formed in a roll; and a continuous towel sheet.

10. The dispenser of claim 1, further comprising a plurality of fluid reservoirs, each reservoir being configured to receive and store a different fluid therein.

11. A portable dispenser configured to dispense towels selectively treated with a fluid, comprising:

a compartment, configured to contain at least one dispensable towel therein;

a removable cover, disposable on the compartment to form an enclosure with the compartment;

a fluid reservoir;

a fluid applicator, in fluid communication with the reservoir and being selectively operable by a user of the dispenser to apply the fluid to the dispensable towel;

the enclosure having at least two distinct configurations, including:

i) an upright configuration, in which a longitudinal axis of the enclosure is substantially vertical; and ii) a slanted configuration, in which the longitudinal axis of the enclosure is slanted with respect to vertical;

the fluid applicator and reservoir cooperatively defining a sealed unit to contain the fluid within the cover when the dispenser is oriented in either of the upright configuration and the slanted configuration; and towel dispensing conduit, extending through the cover to a top opening of the cover, the conduit defining a path through which the dispensable towel is extracted from the compartment and dispensed from the top opening of the cover.

12. The dispenser of claim 11, wherein the fluid applicator includes a delivery portion directed toward an inside of the towel dispensing conduit, and wherein the towel dispensing conduit circumscribes the dispensable towel as the towel is extracted from the compartment.

13. The dispenser of claim 12, wherein the towel dispensing conduit has a length and includes a substantially rounded cross section, and wherein the delivery portion of the fluid applicator is directed toward the inside of the conduit at a midpoint along the length of the conduit.

14. The dispenser of claim 13, wherein the fluid applicator includes a selectively operable pump and wherein the delivery portion of the fluid applicator includes a spray nozzle directed toward the inside of the conduit.

15. The dispenser of claim 13, wherein the towel dispensing conduit includes a circular cross section.

16. The dispenser of claim 13, further comprising a second fluid applicator having a second delivery portion directed toward the inside of the towel dispensing conduit.

17. The dispenser of claim 11, wherein the towel dispensing conduit extends at least partially through the fluid reservoir and is substantially centered within a cross section of the fluid reservoir.

18. The dispenser of claim 11, wherein the towel dispensing conduit extends through the fluid reservoir from a bottom of the reservoir to a top of the reservoir.

19. The dispenser of claim 11, further comprising at least one dispensable towel selected from the group consisting of: interfolded towels; a continuous, perforated towel shoot; a continuous, perforated towel sheet formed in a roll; and a continuous towel sheet.

20. The dispenser of claim 11, further comprising a plurality of fluid reservoirs, each reservoir being configured to receive and store a different fluid therein.

* * * * *